United States Patent [19]

Martin

[11] 4,137,725

[45] Feb. 6, 1979

[54] COMPRESSOR CONTROL FOR A REVERSIBLE HEAT PUMP

[75] Inventor: Robert L. Martin, Little Silver, N.J.

[73] Assignee: Fedders Corporation, Edison, N.J.

[21] Appl. No.: 828,759

[22] Filed: Aug. 29, 1977

[51] Int. Cl.[2] ..... F25B 13/00; F25B 29/00

[52] U.S. Cl. ..... 62/160; 62/324; 165/29

[58] Field of Search ..... 62/81, 160, 324, 155, 62/158; 165/29

[56] References Cited

U.S. PATENT DOCUMENTS

| | | | |
|---|---|---|---|
| 2,748,572 | 6/1956 | Parcaro | 62/160 |
| 2,964,922 | 12/1960 | Canter | 62/160 |
| 3,066,496 | 12/1962 | Jokela | 62/160 |
| 3,123,985 | 3/1964 | Burt | 62/160 |
| 3,128,607 | 4/1964 | Kyle | 62/158 |
| 3,170,304 | 2/1965 | Hale | 62/81 |
| 3,230,728 | 1/1966 | Biehn | 62/155 |
| 3,823,572 | 7/1974 | Cochran, Jr. | 62/160 |
| 3,993,121 | 11/1976 | Medlin et al. | 62/160 |
| 4,054,035 | 10/1977 | Trelease | 165/16 |

*Primary Examiner*—Lloyd L. King

*Attorney, Agent, or Firm*—McAulay, Fields, Fisher & Goldstein

[57] ABSTRACT

A control means is provided in the control circuit for a heat pump whereby a change in mode of the heat pump will result in the compressor being deenergized and maintained deenergized for a period of time determined by the control means, to allow equalization of refrigerant pressure within the heat pump system.

5 Claims, 4 Drawing Figures

COMPRESSOR CONTROL FOR A REVERSIBLE HEAT PUMP

BACKGROUND OF THE INVENTION

As is well known, a heat pump usually comprises a compressor, two coils, an expansion device and a reversing valve. The compressor compresses refrigerant into one of the coils which consequently operates as a condenser coil and thereafter the refrigerant liquid passes through an expansion valve and into the other coil, operating as an evaporator. Refrigerant vapor leaves the evaporator to return to the inlet of the compressor, normally through an accumulator. A four-way reversing valve may be utilized to direct the refrigerant from the compressor into either of the two coils and simultaneously direct the output from the other coil to the input of the compressor. In this manner the "role" of the coils can be reversed. The coil operating as a condenser releases heat, normally to air passing over it, while the coil operating as an evaporator will absorb heat, normally from air passing over it. Usually, when one coil is mounted inside and the other outside of a building, the heat pump is considered to be in a heating mode or phase when the inside coil acts as a condenser and in the cooling mode or phase when the inside coil acts as an evaporator.

A problem occurs when the reversal valve of such a heat pump is switched from one mode to the other in that, at the time that the mode is switched, the coil acting as a condenser, and therefore containing refrigerant under high pressure, becomes connected to the compressor intake, while the coil acting as an evaporator, and therefore containing refrigerant at a low pressure, is connected to the compressor output. The result is high pressure refrigerant discharging through the compressor, often still in a liquid state. Aside the objectionable noise caused by refrigerant rushing through the compressor, there is a possibility of damage to the compressor valves. Additionally, dilution of the compressor lubricant by liquid refrigerant will accelerate the deterioration of the compressor due to inadequate lubrication.

A number of solutions to this problem have been suggested by the prior art. For example, U.S. Pat. No. 3,230,728 to Biehn teaches the use of a capillary shunt to the line leading to the input of the compressor. A valve blocks the main line returning to the compressor, forcing the refrigerant to flow through the capillary, for a period of time sufficient to allow the pressure to equalize in the system. U.S. Pat. No. 3,128,607 to Kyle shows a device which provides a time delay on the reversal valve which, when the heating thermostat is satisfied after a period of indoor air heating and although the compressor motor is deenergized, maintains the reversal valve in its energized "heating" mode position for a predetermined period of time rather than allowing it to return to its non-energized "cooling" mode position.

Although it is known to provide a time delay before restarting the compressor of a non-reversible refrigeration unit after the compressor has been deactivated, this is a non-analogous situation to that encountered with respect to the reversal of phase in a heat pump. As noted above, the problems encountered with a reversal in phase of a heat pump are caused by the simultaneous connection of the compressor inlet to a high pressure coil and the compressor outlet to a low pressure coil allowing refrigerant to rush through the compressor. The compressor in a refrigeration unit, on the other hand does not encounter such a reversal, rather, after running for a while and when restarting it is subjected to a high pressure coil connected to its outlet and a low pressure coil connected to its inlet. This places a loud on the motor which usually causes it to stall, overloading the motor and possibly damaging the unit.

SUMMARY OF THE INVENTION

In accordance with the present invention, a control means is provided in the control circuit of a heat pump which means turns off the compressor and thereafter maintains it in a deactivated state for a predetermined period of time, thereby to allow the refrigerant pressure to equalize in the heat pump system.

DESCRIPTION OF THE PREFERRED EMBODIMENTS

Figure 1:
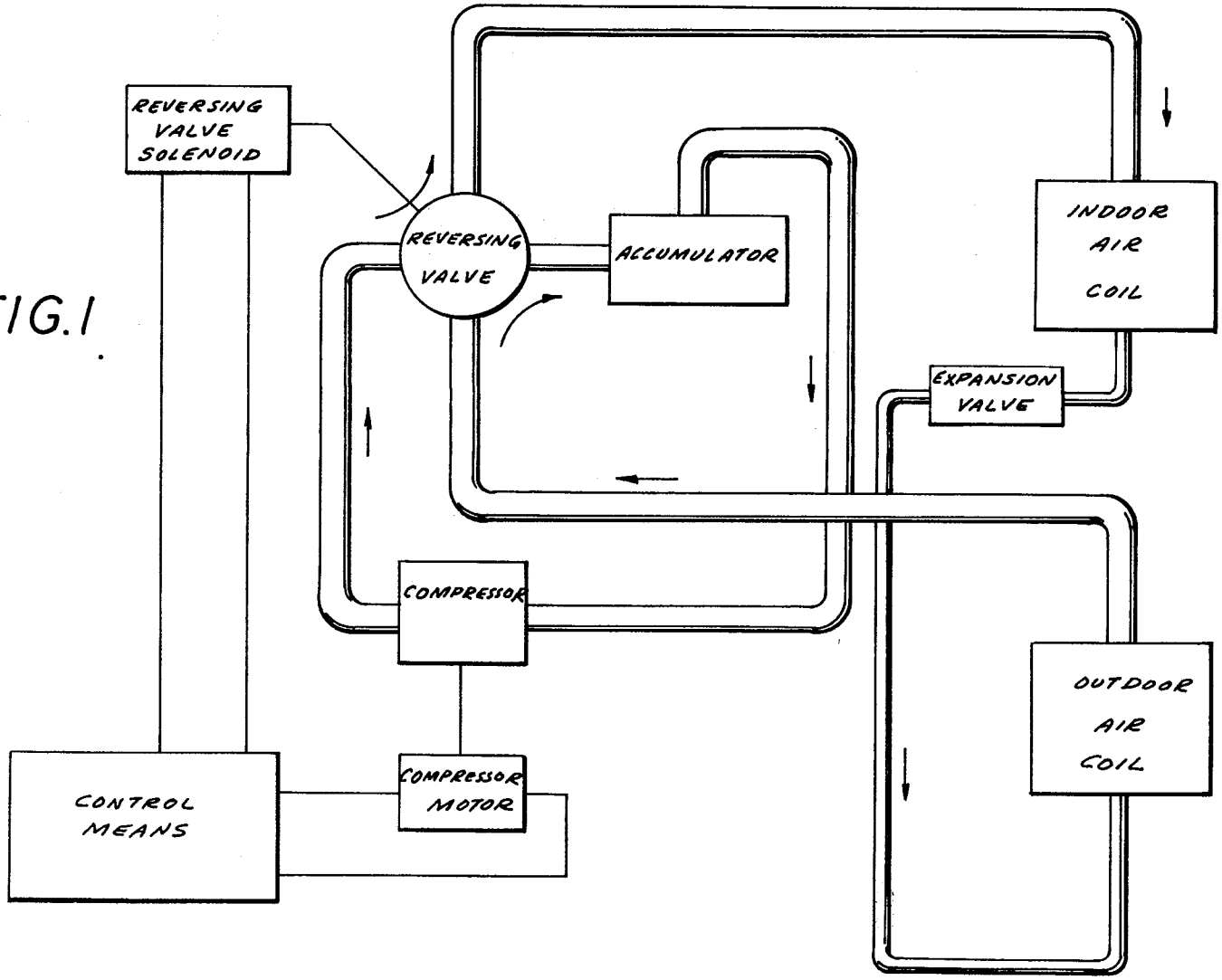
FIG. 1 is a schematic diagram of a reversible heat pump with the control means attached in one embodiment of the invention.

For a fuller description of the invention reference is made to the drawings wherein FIG. 1 is a schematic of a reversible heat pump including the present invention. The arrows show the direction of flow of refrigerant for the heating mode. Refrigerant leaves the compressor passing through the reversing valve and to the indoor air coil wherein the refrigerant gives up heat and is compressed to a liquid. The liquid refrigerant passes through the expansion valve and into the outdoor air coil wherein it evaporates to absorb heat. Finally, the vaporized refrigerant passes back to the compressor via the reversing valve and accumulator. While the reversing valve is switched, the flow of refrigerant through the outdoor coil and the indoor coil is reversed. Switching of the reversing valve is accomplished by the reversing valve solenoid which simultaneously activates the control means, as described in detail below with respect to the embodiment of FIG. 2a. Power to the compressor motor is controlled through the control means which, when switched, will deactivate the compressor motor and maintain it an inactivated state for a predetermined period of time.

Figure 2:
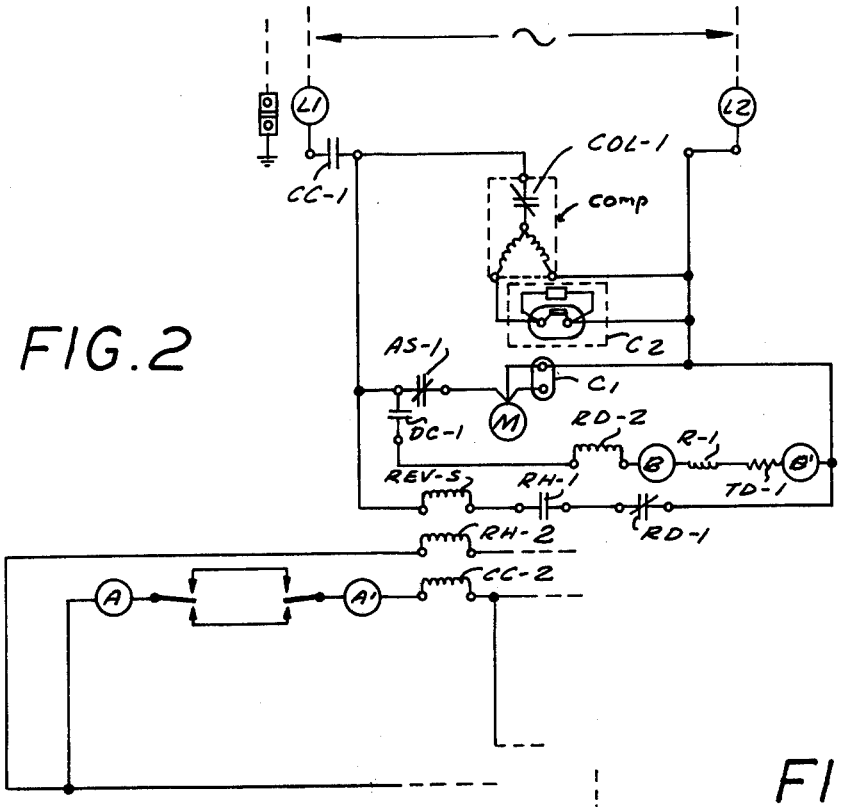
FIG. 2 is an electrical schematic diagram showing a second embodiment of the present invention.
Figure 2A:
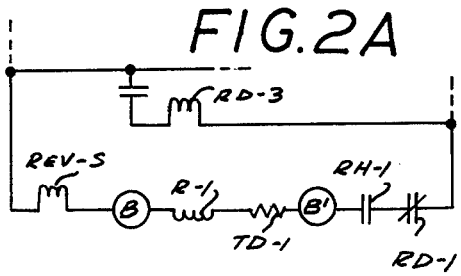
FIG. 2a is a partial schematic of the circuit shown in FIG. 2, showing the embodiment of FIG. 1.

The present invention is intended for use in a usual compressor control circuit such as is partially shown in FIG. 2 and FIG. 2a. In a usual manner, power is supplied through lines L1, L2. The compressor contactor contacts CC-1, which are closed in response to the compressor contactor coil CC-2, complete the circuit to the compressor COMP. A compressor overload switch COL-1, which is internal or external to the compressor, a compressor capacitor and optional start assist device C2, and an outdoor fan motor M along with fan motor capacitor C1 when required depending on the type of motor, are provided as is conventional.

CONTROL DEVICE

Figure 3:
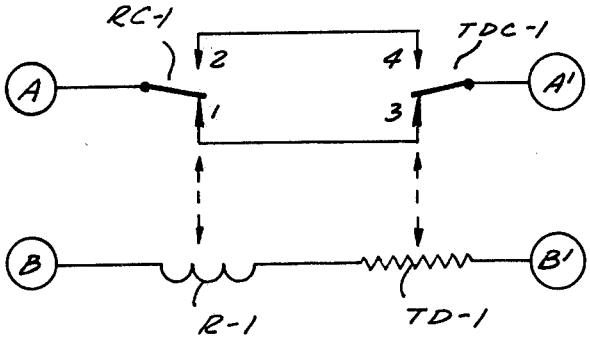
FIG. 3 is a schematic representation of the control means according to the present invention.

One embodiment of the control device is shown in FIG. 3. Relay coil R-1, when activated by current flowing therethrough, will switch the relay contact RC-1 from its normal position 1 as shown, to position 2. A time delay switch device includes a heat switchable device having a time delay heater element TD-1 and time delay contacts TDC-1 which are in series with the relay coil R-1 and the relay contactor RC-1 respectively. Current flowing though the circuit B-B' (R-1/TD-1) shown in FIG. 3, will cause relay contact RC-1 to switch immediately and time delay contact TDC-1 to be switched after a time period depending on the construction and design of the device. A similar, but not necessarily identical, time delay in switching will occur upon cessation of the current flow through B-B'. Thus, current will flow through the circuit A-A' (RC-1/TDC-1), either through the upper 2–4 or the lower 1–3 line except during the delay period when the switching of time delay control TDC-1 lags behind the switching of relay control RC-1.

COOLING MODE

As shown in FIG. 2, the heat pump is normally in the cooling mode, that is, when the contacts are all in their normal or inactivated conditions and the reverse solenoid inactivated the heat pump will operate with the indoor coil acting as an evaporator and absorbing heat. Thus, upon closing of the compressor contactor contacts CC-1, in response to the compressor contactor coil CC-2 activation by circuit components not shown, the compressor will be activated and the heat pump will operate in its cooling mode.

The circuit controlling compressor contactor coil CC-2 includes circuit A-A' of control device according to the present invention. In the embodiment of FIG. 2, the circuit B-B' is not activated with respect to the cooling mode control circuit elements in response to a reversal of modes due to the switching of the reversing solenoid Rev-S. The embodiment of FIG. 2a shows the circuit B-B' in series with the reversing solenoid Rev-S and therefore will operate to control the compressor COMP, in a manner described above, upon each switching of the solenoid Rev-S.

HEATING MODE

With reference to FIG. 2, when the heating relay RH-2 is activated by control components (not shown), the normally open heating relay contacts RH-1 are closed thereby activating the reversing solenoid Rev-S to switch the reversing valve (FIG. 1) to the heating mode position.

As discussed above with respect to the cooling mode, the embodiment of FIG. 2 does not activate the control device due to switching of modes to heating. The FIG. 2*a* embodiment does control the compressor COMP, as noted above, because circuit B-B' is activated or deactivated with each switching of the reversing solenoid Rev-S.

DEFROST MODE

The defrost mode is a temporary switching or deactivation of the reversing solenoid in order to switch the heat pump to the cooling mode. As discussed above, this provides heat at the outdoor coil thereby defrosting it.

An air switch AS-1 is responsive to temperature differences across the outdoor coil, which are indicative of frost, and will deactivate the outdoor fan motor M, in response to a frosted coil.

A similar control for the defrost relay RD-2 is represented by normally open contact DRC-1. Activation of the defrost relay coil RD-2 by the closing of contacts DRC-1 will open the normally closed defrost relay contacts RD-1, deactivating the reversing solenoid Rev-S thereby switching the heat pump to its cooling mode.

As the circuit B-B' is in series with defrost relay coil RD-2, for the embodiment of FIG. 2, the activation of defrost relay coil RD-2 will activate the control device contacts RC-1/TDC-1 and cause the compressor to be controlled, that is, to be deactivated and held in a deactivated condition for the delay period.

The FIG. 2*a* embodiment will also operate to control the compressor as will any switching of the reversing solenoid Rev-S.

ALTERNATIVE CONTROL ELEMENTS

Although particular embodiments are disclosed above, it is not intended that the scope of the application be limited to those embodiments, as other modifications would be obvious to one of ordinary skill in the art, upon reading this application. Thus, other time delay switching devices than the heater tuype device disclosed herein may be substituted for the control device, without departing from the spirit of the application. When utilizing the particular embodiment discussed above, it is possible to eliminate the relay coil R-1 merely by redesigning either the heating relay (embodiment of FIG. 2) or the reversing solenoid Rev-S (embodiment of FIG. 2*a*) to include a set of contacts to replace the relay contacts RC-1.

What is claimed is:

1. In combination with a compressor operated reversible heat pump, control means operable to deactivate the compressor of the heat pump upon switching of modes of the heat pump from heating to defrosting thereby to prevent damage to the compressor due to pressure differences in the heat pump, said control means comprising:

mode responsive switch operable, in response to the switching of modes of the heat pump between the heating and defrosting modes, to deactivate the compressor; and a timer switch operable to reactivate the compressor subsequent, by a predetermined period of time sufficient to allow substantial equalization of pressures in the refrigerant system of the heat pump, to the deactivation of the compressor by the mode responsive switch.

2. In a combination, as claimed in claim 1, said timer switch comprising a thermal time delay relay including a heater element.

3. In a combination, as claimed in claim 2, wherein the compressor is activated and deactivated in response to the activation and deactivation of a compressor contactor, said mode responsive switch comprising a relay including a relay coil and first and second relay contacts, said relay being switched from the first to the second relay contacts in response to the activation of the relay coil, said relay coil being in series with said heater element to form a control activating circuit;

said timer switch having first and second timer switch contacts and being switched from said first to said second timer switch contact in response, after a predetermined period of time sufficient to allow substantial equalization of pressures in the refrigerant system of the heat pump, to the activation of the heater element, and being switched from said second timer switch contacts to said first timer switch contact, after a similar predetermined period of time, in response to the deactivation of the heater element, said first and second timer switch contacts being in series with the respective first and second relay contacts to form a timer circuit through which current can flow only when both the timer switch and the relay are both switched to their corresponding contacts, whereby the delay in switching of the timer switch will prevent current from flowing through either timer circuit for the predetermined period of time.

4. In a combination, as claimed in claim 3, wherein the heat pump is switched from one mode to another by a reversing valve operated by a reversing solenoid, said relay coil being the coil of said reversing solenoid.

5. In a combination, as claimed in claim 3, wherein the compressor is switched to a defrosting mode in response to a defrosting relay, said switch relay being formed as part of said defrost relay.

* * * * *